US007243382B2

(12) United States Patent
Weedling et al.

(10) Patent No.: US 7,243,382 B2
(45) Date of Patent: Jul. 17, 2007

(54) PATIENT TRANSFER MATTRESS HAVING SIDE PULL STRAPS

(76) Inventors: Robert E. Weedling, 4773 Pinehurst Cir., Center Valley, PA (US) 18034; James E. Weedling, 5456 Northwood Dr., Center Valley, PA (US) 18034

( * ) Notice: Subject to any disclaimer, the term of this patent is extended or adjusted under 35 U.S.C. 154(b) by 0 days.

(21) Appl. No.: 11/118,142

(22) Filed: Apr. 29, 2005

(65) Prior Publication Data

US 2005/0246834 A1 Nov. 10, 2005

Related U.S. Application Data

(60) Provisional application No. 60/568,560, filed on May 6, 2004.

(51) Int. Cl.
*A61G 7/10* (2006.01)

(52) U.S. Cl. ..... 5/81.1 R; 5/81.1 HS; 5/703

(58) Field of Classification Search ..... 5/81.1 R, 5/81.1 HS, 703, 711; 16/114.1, DIG. 28
See application file for complete search history.

(56) References Cited

U.S. PATENT DOCUMENTS 1,731,530 A * 10/1929 Goldeeen ..... 5/703
2,366,082 A 12/1944 Baker
4,621,382 A 11/1986 Burriss et al.
4,686,719 A 8/1987 Johnson et al. ..... 5/81 R
5,067,189 A 11/1991 Weedling et al. ..... 5/81 R
RE35,299 E 7/1996 Weedling et al. ..... 5/81.1 T
5,561,873 A 10/1996 Weedling ..... 5/711
5,860,174 A 1/1999 Failor
6,073,291 A * 6/2000 Davis ..... 5/711
2002/0166168 A1 11/2002 Weedling et al. ..... 5/81.1 R

* cited by examiner

*Primary Examiner*—Patricia Engle
*Assistant Examiner*—Fredrick Conley
(74) *Attorney, Agent, or Firm*—Drinker Biddle & Reath LLP

(57) ABSTRACT

A pull member for a patient transfer mattress preferably includes a first portion attached to the inflatable mattress and a second portion attached to the first portion such that a pulling force applied to the second portion is transmitted to the first portion at a location that is substantially equidistant from the top and bottom sheets. The pull member may be T-shaped having a first portion extending along a side panel between the top and bottom sheets or may include a first portion having opposite end attached to the mattress to define a loop. The pull member may include a hand grip to facilitate grasping engagement. The pull member may include a pair of elongated straps and an attachment mechanism for releasable attachment between the strap pair. The pull member may include a connector lug and a clip member for releasable attachment between first and second portions.

6 Claims, 7 Drawing Sheets

PATIENT TRANSFER MATTRESS HAVING SIDE PULL STRAPS

CROSS REFERENCE TO RELATED APPLICATIONS

This application claims priority of U.S. Provisional Application No. 60/568,560, filed May 6, 2004.

FIELD OF THE INVENTION

The invention relates to the field of air-inflatable patient transfer mattresses.

BACKGROUND OF THE INVENTION

Patient transfer mattresses include an inflatable chamber, or chambers, defined between top and bottom sheets. The bottom sheet includes a pattern of small openings creating a cushion of escaping air beneath the mattress that reduces friction between the mattress and a support surface, thereby facilitating sliding movement of the mattress. U.S. Pat. No. 5,561,873 discloses a patient transfer mattress of this type.

These transfer mattresses usually include two or more looped lifting handles secured to the sides of the mattresses, to be grasped by a nurse or other caregiver, for sliding the mattress along a support surface or for lifting the mattress from the support surface. U.S. patent application Ser. No. 10/143,139, published as U.S. Pub. No. 2002/0166168 on Nov. 14, 2002, discloses a patient transfer mattress having looped lifting straps respectively secured at opposite ends to the mattress adjacent the top and bottom sheets of the mattress.

Patient transfer mattresses are used to slide a patient from one support surface, such as an examining table, to a second support surface, such as a gurney. Since a pulling force is applied to slide the mattress, the typical transfer situations require that the nurse position herself with the second support surface located between her and the patient on the first surface. The nurse must then reach over the second support in order to grasp the lifting handles to pull the mattress toward her onto the second support surface. Reaching across the support surface, however, places the nurse in an awkward hunched over posture. Pulling on the handles in a hunched over posture causes spinal compression forces that may, over time, lead to serious back injury.

SUMMARY OF THE INVENTION

According to the present invention, a patient transfer device comprises an inflatable mattress and at least one side pull member. The side pull member preferably includes an elongated portion that allows the caregiver to pull the mattress from a distance from the mattress while standing in an upright posture.

According to one aspect of the invention, the side pull member includes a first portion attached to the inflatable mattress and a second portion attached to the first portion, such that a pulling force applied to the second portion is transmitted to the first portion at a location that is substantially equidistant from the top and bottom sheets. Arranged in this manner, the pulling force applied to the side pull member will be substantially evenly distributed to the top and bottom sheets of the mattress, thereby reducing rotational instability of a patient supported atop the mattress.

According to one embodiment of the invention, the side pull member is substantially T-shaped. The first portion of the T-shaped side pull member is attached to one of the side panels to extend along a surface of the side panel substantially between the top and bottom sheets of the mattress.

According to one embodiment of the invention, the first portion of the side pull member has opposite ends attached to the mattress such that the first portion defines a loop. The loop provides for optional lifting or pulling when the separation between the mattress and the caregiver is short.

According to one embodiment of the invention, the device further includes a hand grip secured to at least one side pull member to facilitate grasping engagement of the side pull member by a user.

According to one embodiment of the invention, the side pull member includes a pair of elongated straps. The pair of straps may carry an attachment mechanism to provide for releasable attachment of the pair of straps to each other. This arrangement facilitates releasable attachment of the transfer device to a support member such as a gurney for example.

According to one embodiment, the first portion of the side pull member includes a connector lug defining a loop adapted for engagement by a clip. The second portion of the side pull member carries a clip for releasable attachment between the first and second portions of the side pull member.

According to one embodiment of the invention, the transfer device further includes an elongated connector strip secured to the bottom sheet of the mattress to extend between oppositely located side pull members. The length of material extending between the opposite pull members facilitates application of slight upward force to the mattress by a caregiver to compensate for patient roll instability that is associated with a patient supported in an off-centered manner.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown. In the drawings.

DETAILED DESCRIPTION OF THE DRAWINGS

Figure 1:
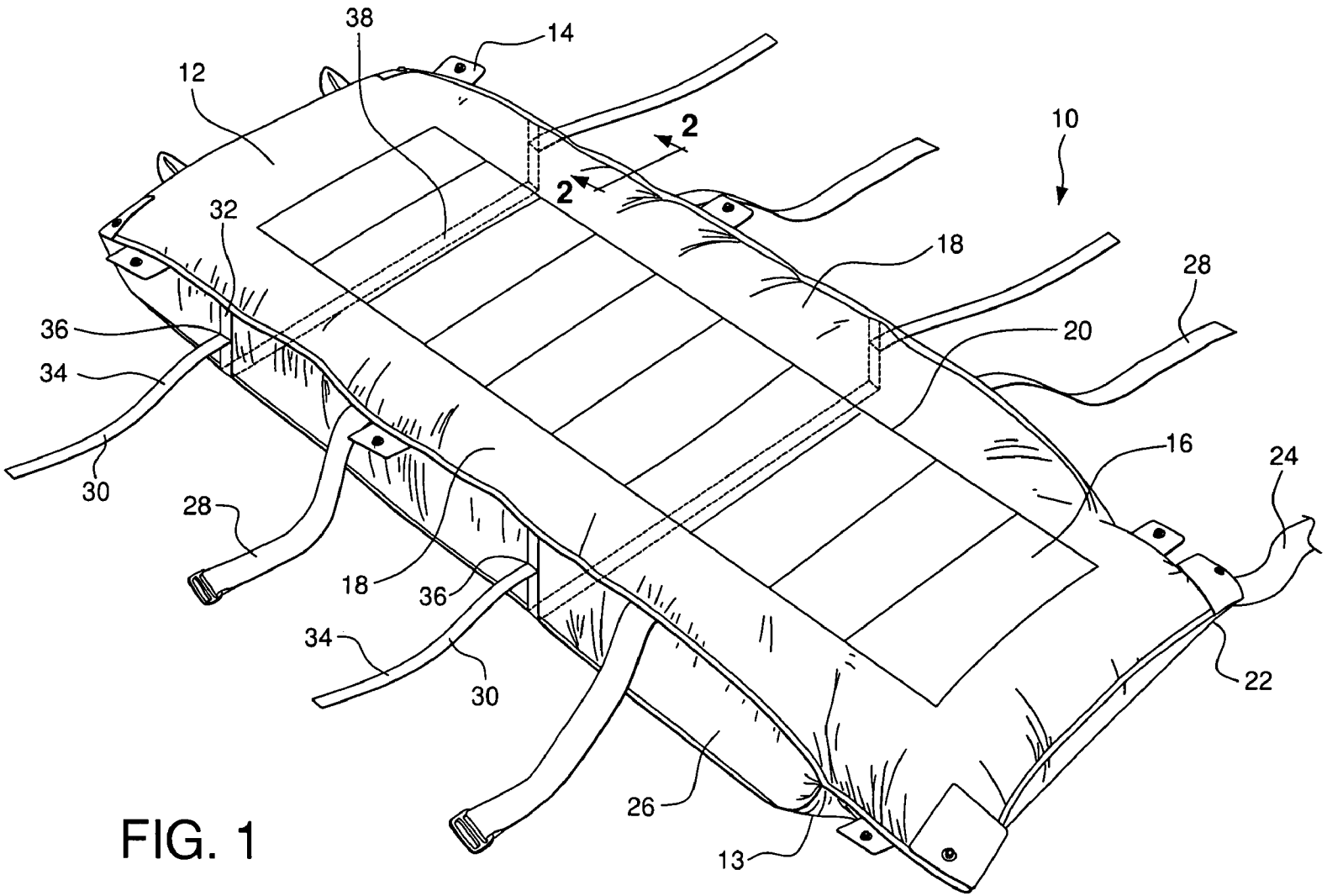
FIG. 1 is a perspective view of a patient transfer mattress according to an embodiment of the invention.
Figure 2:
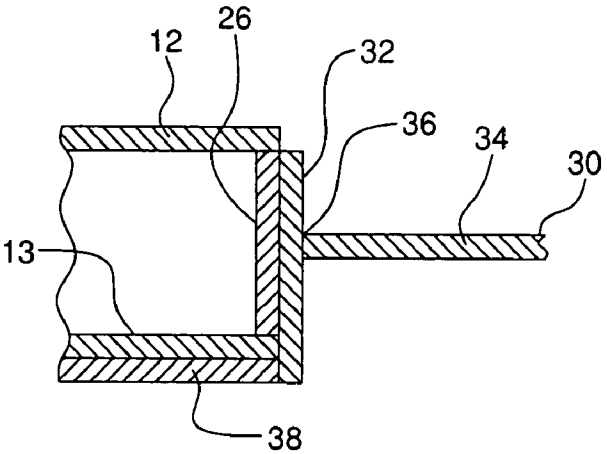
FIG. 2 is a partial sectional view of the transfer mattress of FIG. 1 taken along the line 2-2.

Referring to the drawings, where like numerals identify like elements, FIGS. 1 and 2 depict a patient transfer mattress 10 according to the invention. As described in greater detail below, the invention facilitates sliding a patient-supporting transfer mattress with reduced spinal compression for a nurse or other caregiver applying the pulling force to the mattress. The invention also promotes patient stability by providing for a distributed application of pull force to the mattress and by facilitating application of a slight upward force to the mattress to compensate for an off-centered patient.

The patient transfer mattress includes a top sheet 12 and a bottom sheet 13. The mattress also includes a plurality of inflatable chambers between the top and bottom sheets 12, 13 including transverse chambers 16 and longitudinal side chambers 18. Seams 20 are defined at the transitions between the transverse and side chambers 16, 18. The bottom sheet 13 includes a plurality of holes for creating a cushion of air beneath the mattress 10 to facilitate sliding transfer of the mattress. A hose 24 is connected to an inlet 22 for delivery of air into the inflatable chambers of the mattress 10. A suitable construction for the internal chambers of the inflatable mattress is described in greater detail in U.S. Pat. No. 5,561,873.

The transfer mattress 10 also includes a plurality of fasteners 14 located for attachment of an accessory (not shown), such as a flexible litter, across the upper surface of the mattress 10. The fasteners 14, and assorted accessories for attachment thereto, are described in greater detail in co-pending U.S. patent application Ser. No. 10/143,139, which was published as U.S. Pub. No. 2002/0166168A1 on Nov. 14, 2002.

The transfer mattress 10 also includes elongated patient restraint straps 28 secured to opposite side panels 26 of the mattress 10 for securing a patient supported on the top sheet 12. As shown, the straps 28 located on one side of the mattress 10 include a buckle for receiving the straps 28 from the other side of the mattress. Each of the patient restraint straps 28 is secured to the associated side panel 26 adjacent the top sheet 12 to facilitate placement of the straps 28 across the top of the transfer mattress 10. It is not a requirement of the present invention, however, that the transfer mattress include restraint straps. It is also within the scope of the invention to adapt the pull straps, as described in greater detail below, for optional use of the pull straps to secure a patient to the transfer mattress.

To facilitate sliding transfer of a patient, the transfer mattress 10 includes pull straps 30 on each side of the mattress. Each pull strap 30 is substantially T-shaped having first and second portions 32, 34. The first portion 32 is secured to one of the side panels 26 of the transfer mattress 10 to extend between the top and bottom sheets 12, 13. The second portion 34 of the pull strap 30 is secured at end 36 to the first portion 32 at an intermediate point of the first portion 32 such that the end 36 is located substantially midway between the top and bottom sheets 12, 13, as shown in FIG. 2. Preferably, the pull strap 30 is made from a webbing material, such as a nylon weave, and is secured to the mattress 10 by sewing the first portion 32 to the side panel 26.

Preferably, lengths 38 of material may be sewn to the bottom sheet 13, as shown in broken line in FIG. 1, or to the top sheet 12, or to both the top and bottom sheets 12, 13, to extend between opposite pull straps 30. The inclusion of the lengths of material 38 serves to reinforce the pull straps 30 and limit wearing damage of the pull straps 30 that might otherwise be susceptible to tearing or might separate from the transfer mattress 10. The lengths 38 of material extending across the transfer mattress 10 also serves to distribute pulling forces applied to the pulling straps 30 to the transfer mattress 10 promoting uniform sliding movement and patient stability, which is discussed in greater detail below.

The presence of the pull straps 30 allows a caregiver to grasp the elongated second portion 34 at a distance from the associated side of the mattress 10. A need for the caregiver to be located a distance from the mattress 10 is common when a patient is to be moved from a first support surface, such as an examining table, onto a second support surface located between the mattress 10 and the caregiver, such a gurney. The ability to grasp the pull strap 30 at a distance from the side panel 26 allows the caregiver to assume a comfortable, substantially upright, posture for pulling the transfer mattress 10 from the first support surface to the intermediate second support surface. Such an upright posture greatly reduces the strain imposed on the caregiver's back compared to strains imposed if the caregiver is required to bend over the intermediate second support surface, to grasp a looped handle at the side of the mattress, for example.

The length of the second portion 34 of the pull strap 30 allows a caregiver to engage the pull strap 30 at varying distances from the side of the transfer mattress 10. This facilitates sliding transfer of the mattress 10 by a particular caregiver onto intermediate support surfaces of different widths. It also facilitates use of the mattress 10 by multiple caregivers having different arm lengths.

Figure 3:
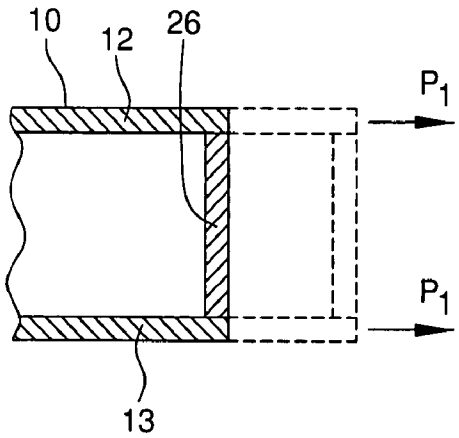

The construction of the pull straps 30 provides for application of a balanced pulling force to the side of the transfer mattress 10. The centralized location of the second portion end 36 between the top and bottom sheets 12, 13 desirably limits rotational instability of a supported patient during sliding movement of the transfer mattress 10 by ensuring that the top and bottom sheets 12, 13 move together. Referring to FIG. 3, the effect that the centralized application of pulling forces has on sliding movement of the mattress is illustrated schematically. Distributed pulling forces, identified in FIG. 3 as $P_1$, are applied evenly to the top and bottom sheets 12, 13, resulting in uniform sliding movement of the mattress 10 in which the top and bottom sheets 12, 13 move together. This is illustrated in FIG. 3 by the broken lines.

Figure 4:
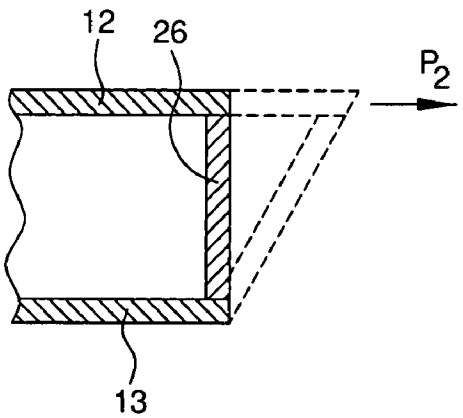
FIGS. 3 and 4 are partial sectional views comparing balanced forces applied by the pull strap of the present invention with pulling force applied adjacent the top sheet of a transfer mattress.

Referring to FIG. 4, the undesirable effect that application of the entire pulling force adjacent the top sheet 12 would have on the transfer mattress is shown schematically. In contrast to the pull strap loading shown in FIG. 3, the force applied to the mattress in FIG. 4 is not distributed uniformly between the top and bottom sheets 12, 13 and is, instead, first applied to the top sheet 12. As a result, the top sheet will tend to move first before the bottom sheet, as shown by broken line in an exaggerated fashion to facilitate the description. Subsequent movement of the bottom sheet 13, which would occur in a sudden manner, could apply a jarring motion to a patient supported on the mattress 10 tending to roll the patient off the mattress 10.

The lengths 38 of material extending across the bottom, top, or both, of the mattress 10 helps to limit tearing-type damage of the pull straps 30 by distributing force applied to the mattress 10 through the pull straps 30. The lengths 38 of material, however, also provide a useful means of dealing with patient instability that is associated with mattress inflation with a patient supported atop the mattress in a misaligned condition. It is sometimes difficult to determine, prior to inflation of the transfer mattress, whether a supported patient is located in an aligned condition with respect to a centerline of the mattress. When a patient is located on a mattress in an off-centered manner, inflation of the mattress causes one side of the mattress to inflate a faster rate than the other side. The uneven inflation of the mattress creates a non-level support surface for the patient that acts like a wedge tending to roll the patient off the mattress.

Patient stability during mattress inflation is a particular concern during procedures that involve patients who are obese or morbidly obese.

In the past, a caregiver identifying an off-center patient during mattress inflation would need to deflate the transfer mattress, reposition the patient, and then re-inflate the mattress. The additional support provided by the lengths 38 of material, however, allows a caregiver to apply a light upward force to the mattress 10, through the pull strap 30 in order to compensate for the above-described wedging factor that tends to roll the patient. It should be understood that the upward force being applied to the pull strap 30 during such an off-center transfer would be small in comparison to the weight of the patient. Thus, the upward force being applied to the pull strap merely provides compensating rotation of the patient acting in opposition to that created by the non-level inflation. The upward force applied to the pull strap 30 would not be a lifting force in the sense of providing complete support for the patient. Instead, the patient remains supported by the mattress and the cushion of air located beneath the inflated mattress, throughout the transfer process.

Figure 5:
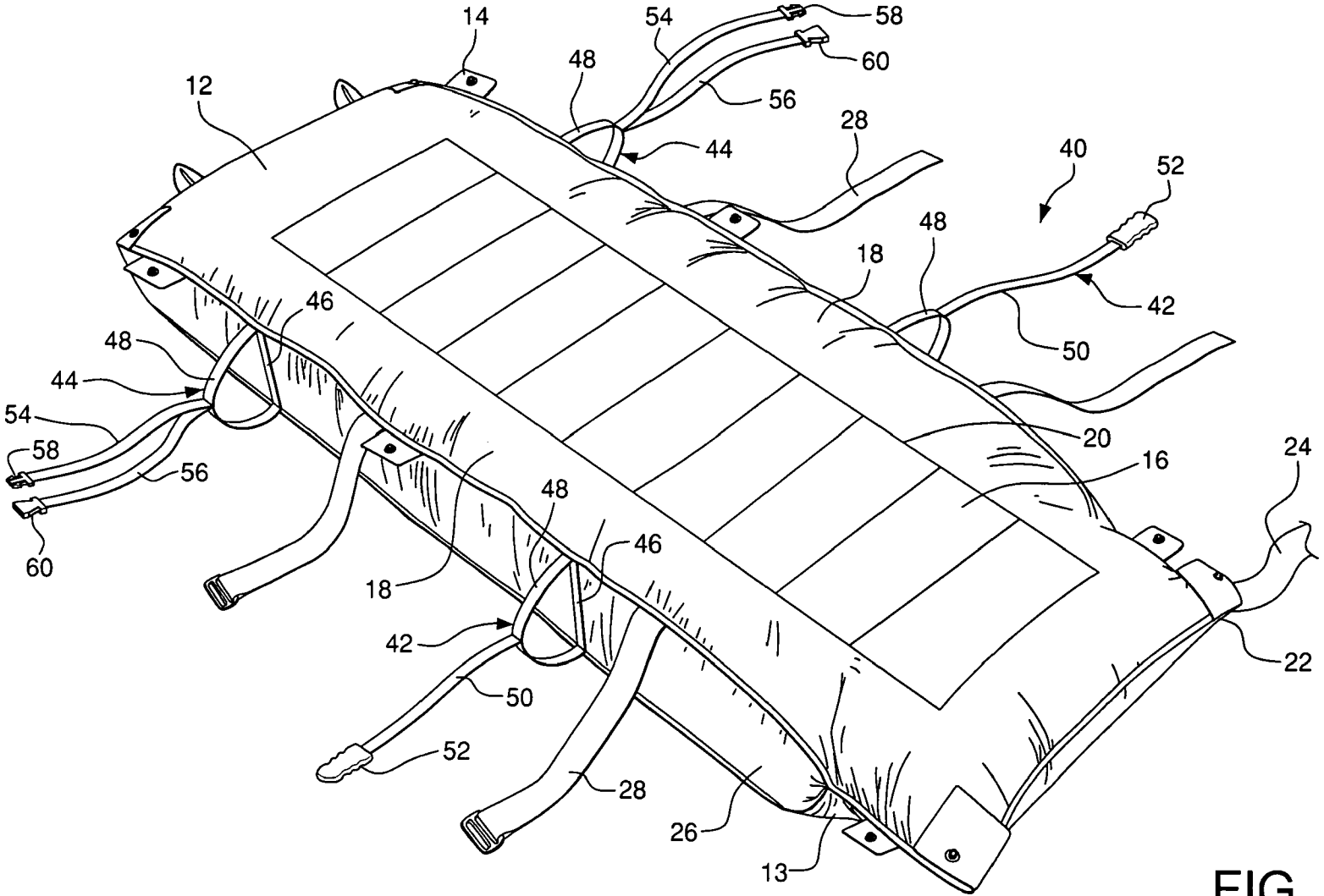
FIGS. 5 through 7 are perspective views of patient transfer mattresses according to the invention including looped strap portions for use as handles.
Figure 6:
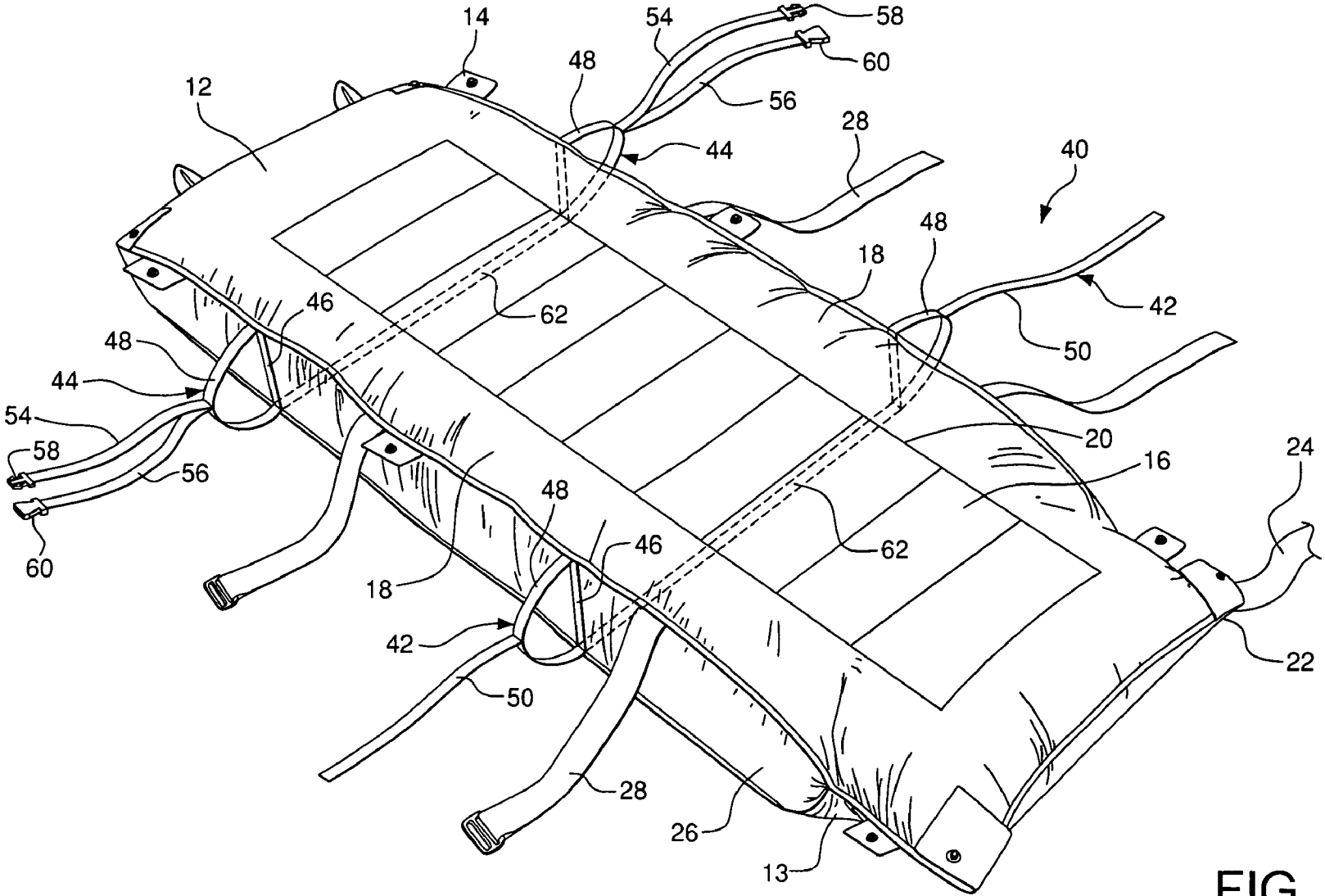
Figure 7:
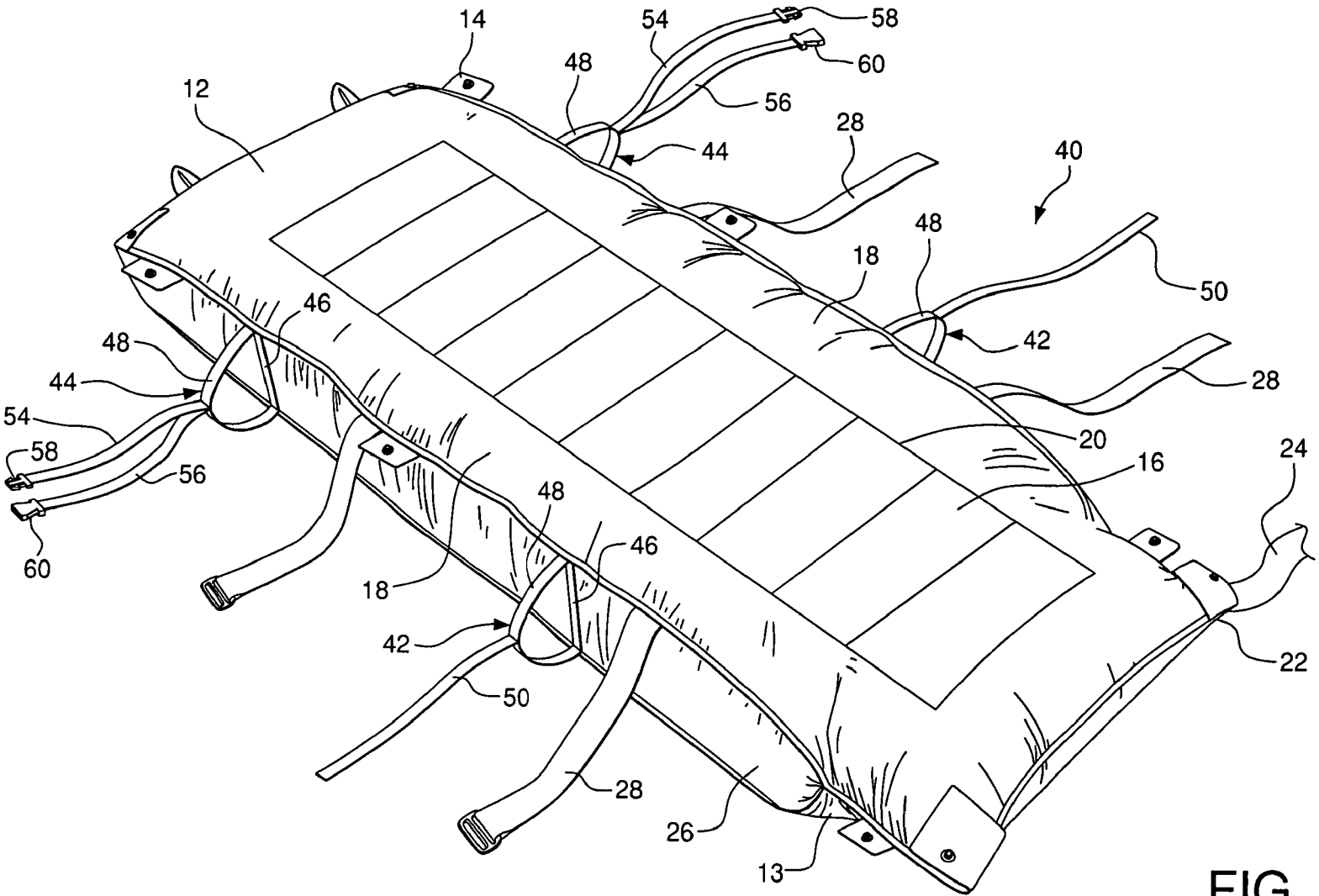

FIGS. 5 through 7 show a patient transfer mattress 40 that includes pull straps 42, 44 on each of opposite sides of the mattress. Each of the pull straps 42, 44 includes a first portion 46 that, similar to the first portion 32 of pull strap 30, is secured to the side panel 26 to extend between the top and bottom sheets 12, 13. Each of the pull straps 42, 44 also includes a looped second portion 48 secured at opposite ends to the side panel 26 adjacent the top and bottom sheets 12, 13. The looped second portion 48 forms a handle for grasping by a caregiver to facilitate sliding movement of the transfer mattress 10 during circumstances when the caregiver stands close to the side of the mattress 40.

The pull straps 42 include an elongated third portion 50 secured at an end to the looped second portion 48 substantially midway between the opposite ends of the looped second portion 48. Similar to the second portion 34 of pull straps 30, the elongated third portion 50 of pull straps 42 allows a caregiver to apply a pulling force to the side of the transfer mattress 40 at a longer distance from the mattress, for transferring a patient to an intermediate support surface for example.

Each of the pull straps 42 for the transfer mattress 40 of FIG. 5 further includes a hand grip 52 formed on a terminal end of the third portion 50 to facilitate grasping engagement of the pulling strap 42 by a caregiver. Preferably, the hand grip 52 is made from a plastic material that is molded onto the terminal end of the pulling strap 42.

Each of the pull straps 44 includes elongated third and fourth portions 54, 56 secured to the looped second portion 48 substantially midway between the opposite ends of the looped second portion. The third and fourth portions 54, 56 are substantially equal in length such that a caregiver could grasp the portions 54, 56 singly or as a pair to apply a pulling force to the side of the transfer mattress 40. As shown in FIG. 5, attachment members 58, 60, such as buckles, are secured to the terminal ends of the third and fourth portions 54, 56, for use of the pull straps 44 to attach the transfer mattress to a support member, such as gurney for example. Any suitable means of securing the third and fourth portions 54, 56 to each other could be used. It is also conceivable that the attachment members 58, 60 could be eliminated and that the third and fourth portions 54, 56 could, instead, be secured together by tying the portions.

The transfer mattress 40 shown in FIG. 6 is substantially similar to the transfer mattress of FIG. 5. The transfer mattress 40 of FIG. 6, however, does not include a hand grip on the terminal end portion of the pull straps 42. Also, the transfer mattress 40 of FIG. 6 includes lengths 62 of material secured to the bottom sheet 13, as shown, or to the top sheet 12, or both the top and bottom sheets 12, 13, to extend between opposite straps 42, 44.

The transfer mattress 40 of FIG. 7 is substantially similar to the transfer mattress of FIG. 6 with the exception that the transfer mattress 40 of FIG. 7 does not include lengths of material secured to the bottom sheet 13 to extend between the opposite sides of the mattress.

Figure 8:
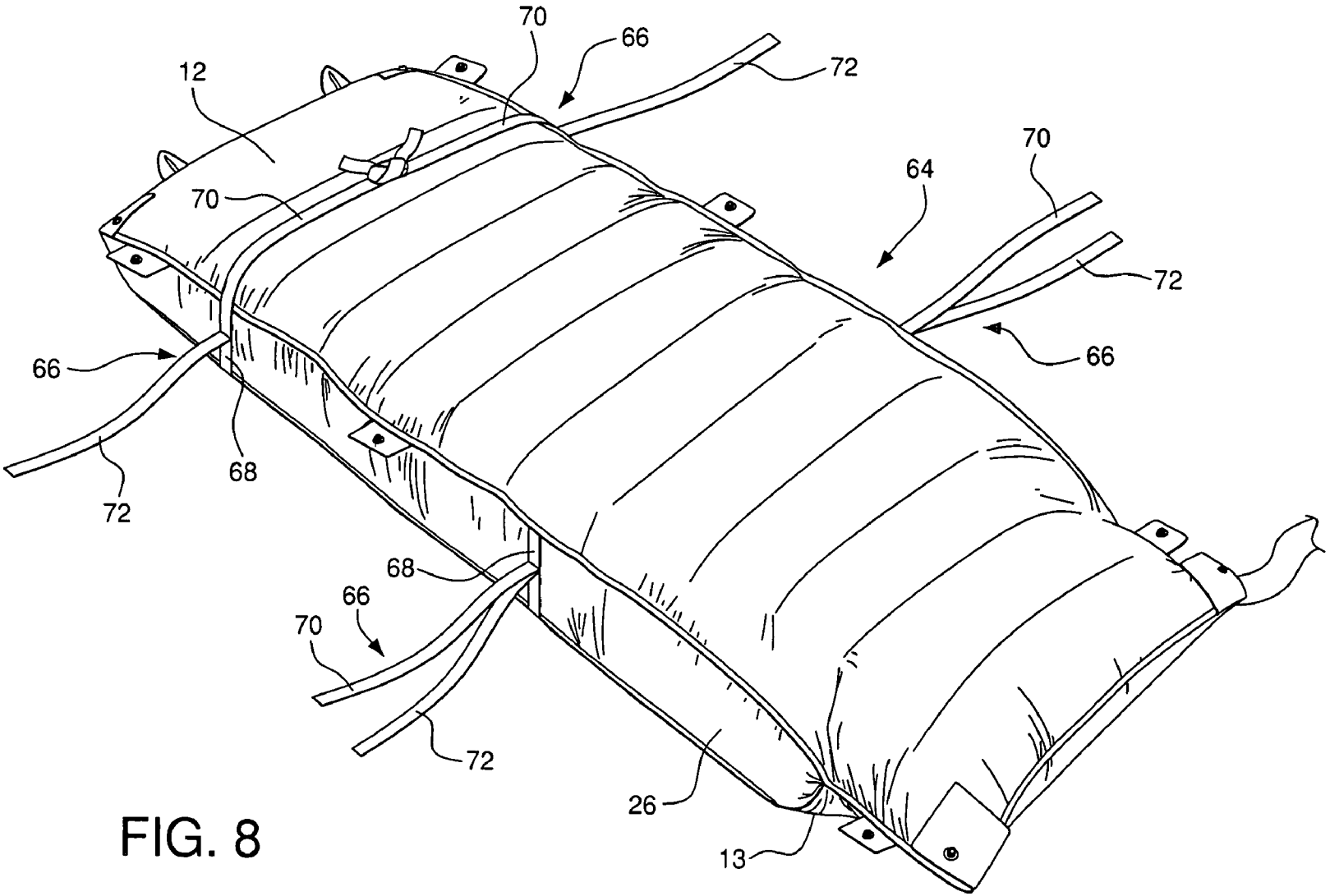
FIG. 8 is a perspective view of a patient transfer mattress according to the invention having side pull straps adapted for patient restraint.

Referring to FIG. 8, there is shown a transfer mattress 64 according to the present invention having pull straps 66 secured to the sides of the mattress. Each pull strap 66 includes a first portion 68 secured to a side panel 26 of the transfer mattress 10 to extend between the top and bottom sheets 12, 13. Each pull strap 66 also includes elongated second and third portions 70, 72 secured to the first portion 68 substantially midway between the top and bottom sheets 12, 13. The elongated second and third portions 70, 72 of pull straps 66 may be grasped by a caregiver located at a distance from the mattress, for transferring a patient to an intermediate support surface for example.

As shown in FIG. 8, the second and third portions 70, 72 have a sufficient length such that the second portions 70 of opposite pull straps 66 may be brought together at their ends and secured to each other. Used in this manner, the second portions 70 of the pull straps 66 could be used to secure a patient to the mattress 64. The elongated third portions 72 of the pull straps would still remain unattached and, therefore, could be grasped by a caregiver located at a distance from the transfer mattress 64. The optional use of the second portions 70 of pull straps 66 for securing a patient provides for elimination of patient restraint straps, such as straps 28 that were included in mattress 10 of FIG. 1.

In FIG. 8, the ends of the second portions 70 are shown tied together. It should be understood, however, that the ends of the second portions 70 could carry attachment means, such as buckles for example, for securing the ends together.

It should be understood that the present invention is not limited to incorporation in newly made mattresses and could be applied to existing transfer mattresses by adding the pull straps to the existing mattress in a retro-fit operation.

Figure 9:
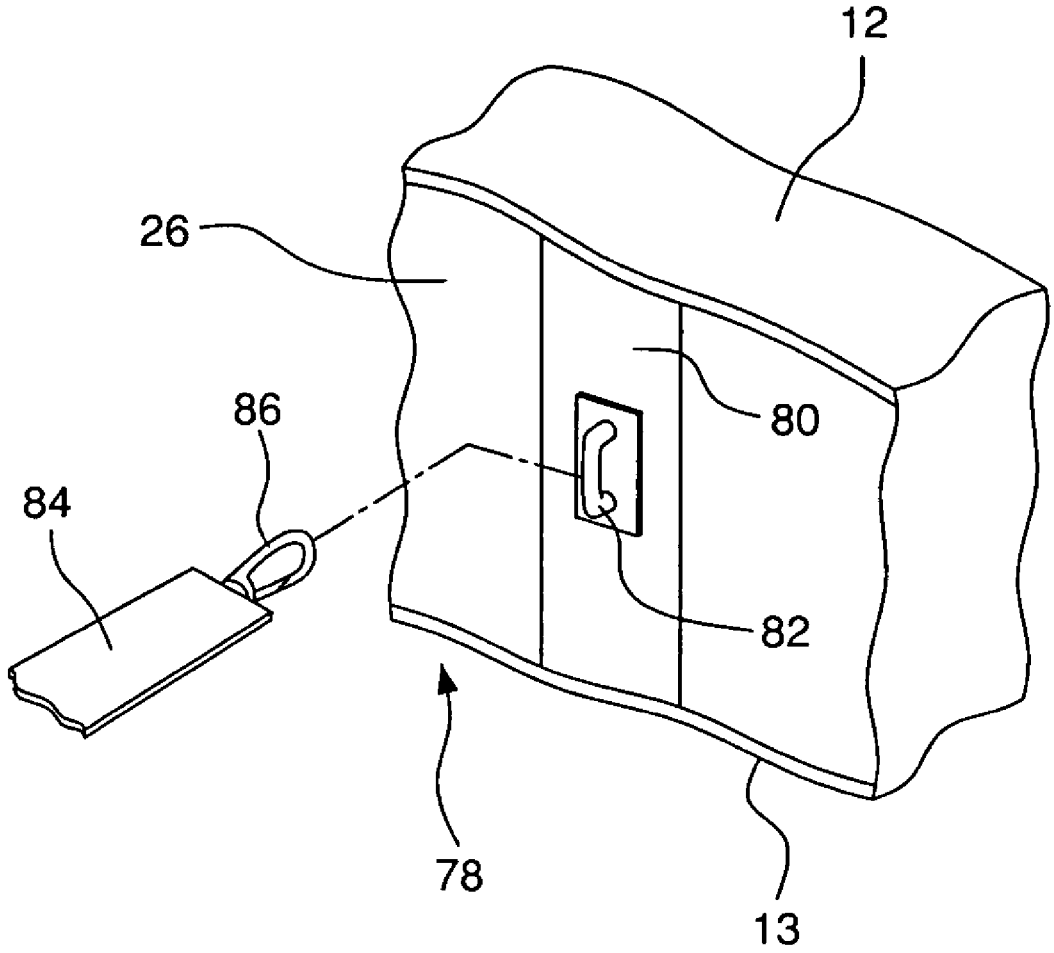
FIG. 9 is a partial perspective view of a pull strap for a patient transfer mattress according to the invention that is releasably attachable to the transfer mattress.

Each of the pull straps is shown in the Figures secured to the side panel 26 of the transfer mattress. As discussed above, the pull straps are preferably secured to the transfer mattress by sewing the pull strap. It should be understood, however, that the present invention is not limited to pull straps permanently secured to the transfer mattress. It is within the scope of the invention to adapt the pull straps to provide releasable attachment between the pull straps and the transfer mattress. Referring to FIG. 9, for example, a pull strap 78 according to the invention includes a first portion 80 secured to the side panel, such as by sewing for example, to extend between the top and bottom sheets 12, 13 of the transfer mattress. A connecting lug 82 is secured to the first portion substantially midway between the top and bottom sheets 12, 13. The pull strap 78 further includes an elongated second portion 84 for grasping by a care giver located at a distance from the transfer mattress, in a similar manner to the second portion 34 of pull strap 30, for example. A releasable clip member 86, such as those used to releasably secure straps to luggage for example, is secured to one end of the second portion 84 for attachment of the second portion 84 to the connecting lug 82 of the first portion 80.

The foregoing describes the invention in terms of embodiments preferred by the inventor for which an enabling description was available, notwithstanding that insubstantial modifications of the invention, including those not presently foreseen, may nonetheless represent equivalents thereto.

What is claimed is:

1. A patient transfer device comprising:

an inflatable mattress having a top sheet, a bottom sheet and side panels extending between the top and bottom sheets, the bottom sheet including a plurality of openings arranged to provide a cushion of escaping air beneath the mattress to facilitate sliding of the mattress with respect to an underlying support surface; and at least one side pull member including a first portion attached to the inflatable mattress and a second portion attached to the first portion such that a pulling force applied to the second portion is transmitted to the first portion at a location that is substantially equidistant from the top and bottom sheets the second portion of the side pull member includes a pair of elongated straps each connected at an end of the elongated strap to the first portion of the side pull member, wherein the side pull member includes an attachment mechanism having first and second portions adapted for releasable engagement therebetween, the first and second portions of the attachment mechanism carried by the pair of elongated straps of the second portion to provide for releasable attachment of the pair of elongated straps to each other.

2. A patient transfer device comprising:

an inflatable mattress having a top sheet, a bottom sheet and side panels extending between the top and bottom sheets, the bottom sheet including a plurality of openings arranged to provide a cushion of escaping air beneath the mattress to facilitate sliding of the mattress with respect to an underlying support surface; and at least one side pull member including a first portion attached to the inflatable mattress and a second portion attached to the first portion such that a pulling force applied to the second portion is transmitted to the first portion at a location that is substantially equidistant from the top and bottom sheets, wherein the first portion of the side pull member includes a connector lug defining a loop adapted for engagement by a clip, and wherein the second portion of the side pull member carries a clip for releasable attachment between the first and second portions of the side pull member.

3. The patient transfer device according to claim 2, wherein the first portion of the side pull member includes a mounting member secured to one of the side panels of the mattress and wherein the connector lug is secured to the mounting member.

4. A patient transfer device comprising:

an inflatable mattress having a top sheet, a bottom sheet and side panels extending between the top and bottom sheets, the bottom sheet including a plurality of openings arranged to provide a cushion of escaping air beneath the mattress to facilitate sliding of the mattress with respect to an underlying support surface; and at least one side pull member including a first portion attached to the inflatable mattress and a second portion attached to the first portion such that a pulling force applied to the second portion is transmitted to the first portion at a location that is substantially equidistant from the top and bottom sheets, wherein the at least one side pull member includes at least one pair of side pull members located on opposite sides of the mattress, the device further comprising an elongated connector strip secured to the bottom sheet to extend across a surface of the bottom sheet between each pair of side pull members.

5. A patient transfer device comprising:

an inflatable mattress including a plurality of holes in a bottom sheet of the mattress for creating a load-bearing cushion of discharging air beneath the mattress to facilitate sliding movement of the mattress on an underlying surface;

at least one pair of side pull members located on opposite sides of the mattress from each other, each of the side pull members adapted for application of a pulling force to the mattress to slide the mattress on the underlying surface; and an elongated connector strip secured to the bottom sheet to extend between the pair of side pull members.

6. A patient transfer device comprising:

an inflatable mattress including a plurality of openings in a bottom sheet to provide a cushion of escaping air beneath the mattress to facilitate sliding of the mattress with respect to an underlying support surface;

at least one side pull member adapted for application of a pulling force to a side of the mattress to slide the mattress on the underlying support surface; and an attachment mechanism having first and second portions adapted for releasable engagement therebetween, at least one of the first and second portions of the attachment mechanism secured to the side pull member to provide for removal of at least a portion of the side pull member.

* * * * *